US006776894B1

(12) United States Patent
Pütter et al.

(10) Patent No.: US 6,776,894 B1
(45) Date of Patent: Aug. 17, 2004

(54) METHOD FOR PRODUCING CARBONYL COMPOUNDS WHICH ARE OXIDIZED IN POSITION ALPHA

(75) Inventors: Hermann Pütter, Neustadt (DE); Kerstin Schierle-Arndt, Mannheim (DE); Jörg Botzem, Limburgerhof (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 10/030,173

(22) PCT Filed: Jul. 21, 2000

(86) PCT No.: PCT/EP00/07026

§ 371 (c)(1),
(2), (4) Date: Jan. 31, 2002

(87) PCT Pub. No.: WO01/11111

PCT Pub. Date: Feb. 15, 2001

(30) Foreign Application Priority Data

Aug. 6, 1999 (DE) ..... 199 37 108

(51) Int. Cl.[7] ..... C25B 3/00; C25B 3/02
(52) U.S. Cl. ..... 205/450; 205/452; 205/453
(58) Field of Search ..... 205/450, 452, 205/453

(56) References Cited

U.S. PATENT DOCUMENTS 5,266,171 A * 11/1993 Hermeling ..... 204/59 R

FOREIGN PATENT DOCUMENTS

EP 0 460 451 12/1991

OTHER PUBLICATIONS

Shono et al., "Electro–organic Chemistry. Part 83. Electro–organic Transformation of Aldehydes and Ketones to a–Hydroxylated Acetals Utilizing Mediators and Some Synthetic Uses of the Products", J. Chem. Soc., Perkin Trans. 1, pp. 73–77, month unavailable, 1986.*

T. Shono: "Electro–organic chemistry. Part 93. Elecro–organic transformation of aldehydes and ketones to alpha–hydroxylated acetals using mediators and some synthetic uses of the products" Journal of the Chemical Society, Perkin Transactions 1, pp. 73–77 1986 month unavailable.

* cited by examiner

*Primary Examiner*—Edna Wong
(74) *Attorney, Agent, or Firm*—Oblon, Spivak, McClelland, Maier & Neustadt, P.C.

(57) ABSTRACT

A method for producing compounds which are oxidized in an alpha position by electrochemical reaction with alcohol in the presence of an auxiliary electrolyte and catalytic amounts of a metal salt.

38 Claims, No Drawings

METHOD FOR PRODUCING CARBONYL COMPOUNDS WHICH ARE OXIDIZED IN POSITION ALPHA

The present invention relates to a process for the preparation of a compound of the general formula I

I

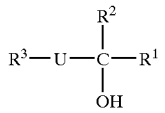

where $R^1$, $R^2$, $R^3$ are hydrogen, $C_1$- to $C_{20}$-alkyl, $C_2$- to $C_{20}$-alkenyl, $C_2$- to $C_{20}$-alkynyl, $C_3$- to $C_{12}$-cycloalkyl, $C_4$- to $C_{20}$-cycloalkyl-alkyl, $C_1$- to $C_{20}$-hydroxyalkyl, or aryl or $C_7$- to $C_{20}$-arylalkyl which is unsubstituted or substituted by $C_1$- to $C_8$-alkyl, $C_1$- to $C_8$-alkoxy, halogen, $C_1$- to $C_4$-haloalkyl, $C_1$- to $C_4$-haloalkoxy, phenyl, phenoxy, halophenyl, halophenoxy, carboxyl, $C_2$- to $C_8$-alkoxycarbonyl or cyano, or $R_1$ and $R^2$ or $R^3$ together are a $C_2$- to $C_9$-alkanediyl unit which is unsubstituted, monosubstituted or disubstituted by $C_1$- to $C_8$-alkyl, $C_1$- to $C_8$-alkoxy and/or halogen and in which one or two methyl groups may also be replaced by a (CH═CH) unit and $R^3$ is additionally an acetylated carbonyl group in which the alkoxy groups are derived from an alcohol of the general formula II $$R^4—OH \quad \text{II}$$

where $R^4$ is $C_1$- to $C_6$-alkyl, and

U is an acetylated carbonyl group in which the alkoxy groups are derived from an alcohol of the general formula II, or is a compound of the general formula III $$R^3—V—W—R^1 \quad \text{III}$$

where $R_1$ is as defined under the formula I, and $R^3$ is exclusively aryl which is unsubstituted or substituted by $C_1$- to $C_8$-alkyl, $C_1$- to $C_8$-alkoxy, halogen, $C_1$- to $C_4$-haloalkyl, $C_1$- to $C_4$-haloalkoxy, phenyl, phenoxy, halophenyl, halophenoxy, carboxyl, $C_2$- to $C_8$-alkoxycarbonyl or cyano, V is a carbonyl group or is as defined for U under the formula I, and W is as defined for V, with the proviso that one of the groups V and W is a carbonyl group and the other is an acetylated carbonyl group, or a compound of the general formula IV $$R^3—V—W—O—R^4 \quad \text{IV}$$

where R4 is as defined under the formula II, V and W are as defined under the formula III and R3 is as defined under the formula III, by subjecting a compound of the general formula V

V

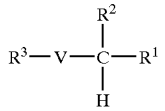

where V, $R^1$, $R^2$ and $R^3$ are as defined under the formula I or III, with the proviso that in the case where a compound of the formula III is desired, use is only made of a compound Va in which $R^1$ is exclusively hydrogen and $R^3$ is exclusively aryl which is unsubstituted or substituted by $C_1$- to $C_8$-alkyl, $C_1$- to $C_8$-alkoxy, halogen, $C_1$- to $C_4$-haloalkyl, $C_1$- to $C_4$-haloalkoxy, phenyl, phenoxy, halophenyl, halophenoxy, carboxyl, $C_2$- to $C_8$-alkoxycarbonyl or cyano, and in the case where a compound of the formula IV is desired, use is only made of a compound Vb in which $R^1$ and $R^2$ are exclusively hydrogen, $R^3$ is exclusively aryl which is unsubstituted or substituted by $C_1$- to $C_8$-alkyl, $C_1$- to $C_8$-alkoxy, halogen, $C_1$- to $C_4$-haloalkyl, $C_1$- to $C_4$-haloalkoxy, phenyl, phenoxy, halophenyl, halophenoxy, carboxyl, $C_2$- to $C_8$-alkoxycarbonyl or cyano, To an electrochemical reaction with an alcohol of the general formula II in the presence of an auxiliary electrolyte and catalytic amount of a metal salt (S) derived from a metal from the $1^{st}$, $2^{nd}$, 6th or $8^{th}$ subgroup (subgroups IB, IIB, VIB or VIIIB; also known as Groups 11, 12, 6 and 8–10, respectively) of the periodic table, or from lead, tin or rhenium.

EP-A-460 451 discloses a process for the preparation of α-hydroxymethyl ketals by electrochemical oxidation of aldehydes or ketones in the presence of alcohols and halogen compounds as auxiliary electrolytes. Repetition of the examples shows that more highly oxidized carbonyl compounds are also formed under the process conditions described if the carbonyl group is in the α-position to an aromatic radical. Thus, for example, a methylene group in the α-position to the carbonyl group can be oxidized to the carbonyl function and in addition the aldehyde or keto carbonyl group originally present can be oxidized to the carboxyl group. Thus, it is not only α-hydroxyketals that are formed, but also α-ketaldehydes, α-ketoacetals, α-ketalcarboxylic esters and α-keto orthoesters. However, this process is still not entirely satisfactory since the overall yield of these target products is relatively low and in addition large amounts of other substantially unusable products are formed.

German Patent Application 19904929, which is not a prior publication, relates to a process for the preparation of 2,2,3,3-tetramethoxypropanol by electrochemical oxidation of methylglyoxal dimethyl acetal using a mixture comprising methanol, water and an auxiliary electrolyte as electrolysis medium and an iron, steel, platinum or zinc cathode.

It is an object of the present invention to provide an electrochemical process by means of which α-hydroxyketals, α-ketalaldehydes, α-ketoacetals, α-ketalcarboxylic esters and α-keto orthoesters can be prepared from keto or aldehyde carbonyl compounds. We have found that this object is achieved by the. process defined above.

The process according to the invention is particularly suitable for the preparation of compounds of the general formulae I, III and IV, where the radical $R^4$ in the acetylated carbonyl group is derived from methanol or ethanol.

Of the compounds of the formula I, preference is given to those of the formula Ia Ia

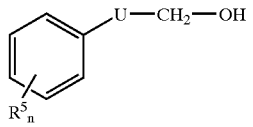

where U is as defined in formula I, n is 0, 1, 2 or 3, and $R^5$ is $C_1$- to $C_8$-alkyl, $C_1$- to $C_8$-alkoxy, halogen, $C_1$- to $C_4$-haloalkyl, $C_1$- to $C_4$-haloalkoxy, phenyl, phenoxy, halophenyl, halophenoxy, carboxyl, $C_2$- to $C_8$-alkoxycarbonyl or cyano.

Preference is likewise given to compounds of the general formula IIIa

IIIa

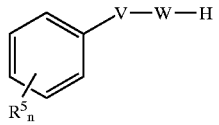

where n, V, W and $R^5$ are as defined under the formula Ia or III, or of the general formula IVa IVa

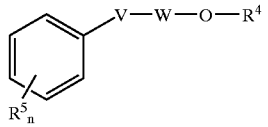

where n, V, W, $R^4$ and $R^5$ are as defined under the formula Ia or IIIa.

These compounds are prepared by employing as starting compound of the general formula V a compound of the general formula Va Va

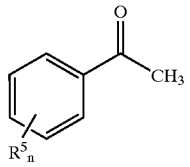

where n and $R^5$ are as defined under the formula Ia.

The process is furthermore particularly suitable for the preparation of compounds of the general formula:

$$H_{2m+1}C_m—CHOH—CH(OR^4)_2$$

where m is a number from 1 to 10, and $R^4$ is as defined in formula II, and for whose preparation use is made of a compound of the general formula:

$$H_{2m+1}C_m—CH_2—CHO—$$

The process is very particularly suitable for the preparation of 2-phenyl-2,2-dimethoxyethanol, 2-phenyl-2,2-dimethoxyacetaldehyde and 2-phenylglyoxal dimethyl acetal from methanol and acetophenone α-hydroxyoctanal dimethyl acetal from octanal and 2,2,3,3-tetramethoxypropanol from methylglyoxal dimethyl acetal.

The auxiliary electrolyte present in the electrolysis solution is generally a halogen-containing auxiliary electrolyte, such as elemental halogen, an alkyl halide or a hydrogen halide. Halogen-containing salts, in particular iodides or bromides, can also preferably be employed. Examples are ammonium halides, such as ammonium bromide, ammonium iodide and tetrabutylammonium iodide. Particularly preferred metal halides are furthermore alkali metal halides, such as sodium bromide, sodium iodide, potassium iodide and potassium bromide.

The metal salts (S) are preferably those derived from mineral acids. The anions of the metal salt are thus, for example, phosphate, sulfate, nitrate, perchlorate or halide.

The cations of the metal salt (S) are preferably iron, nickel, platinum, palladium, cobalt, zinc, silver or copper ions. The metal salt (S) is generally added to the electrolysis solution in amounts such that its metal ions are present therein in amounts of from 1 to 1000 ppm by weight, preferably from 5 to 500 ppm by weight, particularly preferably from 5 to 300 ppm by weight, based on the total amount of electrolysis liquid.

If desired, conventional co-solvents are added to the electrolysis liquid. These are the inert solvents having a high oxidation potential which are generally conventional in organic chemistry. Examples which may be mentioned are dimethyl carbonate and propylene carbonate. Besides said co-solvents, water can also be added to the electrolysis liquid, although the water content should not exceed 5% by weight, based on the total amount of electrolysis liquid.

In general, the electrolysis liquid has the following composition:

a starting compound of the general formula V an alcohol of the general formula II a halogen-containing auxiliary electrolyte catalytic amounts of the metal salt (S)

possibly the desired products of the general formulae I, III and IV possibly other by-products of electrolysis which are derived from the compounds of the general formulae I, II, III, IV and V if desired, other conventional co-solvents.

The ratio between the products of the general formulae I and V and the other by-products to the starting compounds in the electrolysis liquid and the ratio of the individual products having different degrees of oxidation to one another is of course, dependent on the progress of the reaction.

The ratio between the products of the general formulae I, III, IV and V and the other by-products to the starting compounds in the electrolysis liquid and the ratio of the individual products having different degrees of oxidation to one another is of course dependent on the progress of the reaction.

In general, the amount of charge expended for the reaction is from 1 to 7 F per mole of starting compound of the general formula V. From 3.5 to 4 F are preferably employed if mixtures are desired which are intended to contain, as principal components, compounds of the formulae I and III, and from 4.5 to 5.5 F are employed if mixtures are desired which are intended to contain, as principal components, compounds of the formulae I and IV.

The process according to the invention can be carried out in all conventional types of electrolysis cell. Preference is given to undivided flow cells.

The current densities at which the process is carried out are generally from 0.5 to 25 A/dm$^2$. The temperatures are usually from −20 to 60° C., preferably from 0 to 60° C. The process is generally carried out at atmospheric pressure. Higher pressures are preferably used if higher temperatures are to be used in order to prevent the starting compounds or co-solvents from boiling.

Examples of suitable anode materials are noble metals such as platinum, or metal oxides, such as ruthenium or chromium oxide, or mixtures of the $RuO_x/TiO_x$ type. Preference is given graphite or carbon electrodes.

Suitable cathode materials are generally iron, steel, nickel, and noble metals, such as platinum and graphite and carbon materials.

When the reaction is complete, the electrolysis liquid is worked up by general separation methods. To this end, the electrolysis liquid is generally first distilled, and the individual compounds are obtained separately in the form of different fractions. Further purification can be carried out, for example, by crystallization or chromatography.

Experimental Part

All experiments were carried out in an undivided cell having 11 bipolar electrodes (10 gaps, gap separation 1.5 mm).

Current density: 3.4 A/dm$^2$

Flow rate: 400 l/h

EXAMPLE 1

| | |
|---|---|
| Batch: | 450 g of acetophenone<br>30 g of potassium iodide<br>2460 g of methanol<br>Fe(III): 5 ppm |
| Cathode: | steel 1.4301 |
| Anode: | graphite |
| Duration: | 7.03 h |
| Temperature: | 36° C. |
| Amount of charge: | 3.5 F |
| Current strength; | 5 A |
| Conversion: | >99% |
| Yields of the target products: | |
| 2-phenyl-2,2-dimethoxyethanol: | 24% |
| 2-phenyl-2,2-dimethoxyacetaldehyde: | 42% |
| 2-phenylglyoxal dimethyl acetal: | 0% |
| phenylglyoxylic acid methyl orthoester and methyl | |
| 2-phenyl-2,2-dimethoxy acetate: | 0% |
| Total: | 66% |

EXAMPLE 2

| | |
|---|---|
| Batch: | 450 g of acetophenone<br>30 g of potassium iodide<br>2460 g of methanol<br>Fe(III): 5 ppm |
| Cathode: | Graphite |
| Anode: | Graphite |
| Duration: | 7.03 h |
| Temperature: | 36° C. |
| Amount of charge: | 3.5 F |
| Current strength; | 5 A |
| Conversion: | 84% |

-continued

| | |
|---|---|
| Yields of the target products: | |
| 2-phenyl-2,2-dimethoxyethanol: | 15% |
| 2-phenyl-2,2-dimethoxyacetaldehyde: | 24% |
| 2-phenylglyoxal dimethyl acetal: | 8% |
| phenylglyoxylic acid methyl orthoester and methyl | |
| 2-phenyl-2,2-dimethoxy acetate: | 3% |
| Total: | 50% |

EXAMPLE 3 (4118/98-176)

| | |
|---|---|
| Batch: | 450 g of acetophenone<br>90 g of potassium iodide<br>2460 g of methanol<br>Fe(III): 5 ppm |
| Cathode: | steel 1.4301 |
| Anode: | graphite |
| Duration: | 7.03 h |
| Temperature: | 55–58° C. |
| Amount of charge: | 3.5 F |
| Current strength; | 5 A |
| Conversion: | 88% |
| Yields of the target products: | |
| 2-phenyl-2,2-dimethoxyethanol: | 38% |
| 2-phenyl-2,2-dimethoxyacetaldehyde: | 19% |
| 2-phenylglyoxal dimethyl acetal: | 12% |
| phenylglyoxylic acid methyl orthoester and methyl | |
| 2-phenyl-2,2-dimethoxy acetate: | 1% |
| Total: | 70% |

EXAMPLE 4

| | |
|---|---|
| Batch: | 450 g of acetophenone<br>90 g of potassium iodide<br>2460 g of methanol<br>Fe(III): 5 ppm |
| Cathode: | steel 1.4301 |
| Anode: | graphite |
| Duration: | 10.47 h |
| Temperature: | 55–58° C. |
| Amount of charge: | 5.5 F |
| Current strength: | 5 A |
| Conversion: | >99% |
| Yields of the target products: | |
| 2-phenyl-2,2-dimethoxyethanol: | 39% |
| 2-phenyl-2,2-dimethoxyacetaldehyde: | 0% |
| 2-phenylglyoxal dimethyl acetal: | 3% |
| phenylglyoxylic acid methyl orthoester and methyl | |
| 2-phenyl-2,2-dimethoxy acetate: | 39% |

EXAMPLE 5

| | |
|---|---|
| Batch: | 450 g of octanal<br>90 g of potassium iodide<br>2460 g of methanol<br>Fe(III): 5 ppm |

-continued

| | |
|---|---|
| Cathode: | MKUS-F04 (SGL) |
| Anode: | Graphite felt RVG 2003, 6 mm (Deutsche Carbon) |
| Duration: | 3.76 h |
| Temperature: | 55–58° C. |
| Amount of charge: | 2 F |
| Current strength: | 5 A |
| Conversion: | >99% |
| Yield: | 37% α-hydroxyoctanal dimethyl acetal |

EXAMPLE 6

| | |
|---|---|
| Batch: | 450 g of octanal<br>90 g of potassium iodide<br>2460 g of methanol<br>Fe(III): 5 ppm |
| Cathode: | MKUS-F04 (SGL) |
| Anode: | Graphite felt RVG 2003, 6 mm (Deutsche Carbon) |
| Duration: | 3.76 h |
| Temperature: | 26–28° C. |
| Amount of charge: | 2 F |
| Current strength: | 5 A |
| Conversion: | >97% |
| Yield: | 45% α-hydroxyoctanal dimethyl acetal |

EXAMPLE 7

| | |
|---|---|
| Batch: | 450 g of methylglyoxal dimethyl acetal<br>45 g of potassium iodide<br>2505 g of methanol<br>0.11 g $NiSO_4$ |
| Cathode: | graphite |
| Anode: | graphite |
| Duration: | 5 h |
| Temperature: | 30° C. |
| Current strength: | 5 A |
| Conversion: | 52% |
| Selectivity: | 59.4% |
| Yield of 2,2,3,3-tetramethoxypropanol: | 31% |

COMPARATIVE EXAMPLE 1

| | |
|---|---|
| Batch: | 450 g of acetophenone<br>30 g of potassium iodide<br>2460 g of methanol |
| Cathode: | steel 1.4301 |
| Anode: | graphite |
| Duration: | 7.03 h |
| Temperature: | 36° C. |
| Amount of charge: | 3.5 F |
| Current strength; | 5 A |
| Conversion: | 98% |
| Yields of the target products: | |
| 2-phenyl-2,2-dimethoxyethanol: | 19% |
| 2-phenyl-2,2-dimethoxyacetaldehyde: | 12% |
| 2-phenylglyoxal dimethyl acetal: phenylglyoxylic acid methyl orthoester and methyl | 5% |
| 2-phenyl-2,2-dimethoxy acetate: | 9% |
| Total: | 45% |

COMPARATIVE EXAMPLE 2

| | |
|---|---|
| Batch: | 450 g of acetophenone<br>30 g of potassium iodide<br>2460 g of methanol |
| Cathode: | graphite |
| Anode: | graphite |
| Duration: | 7.03 h |
| Temperature: | 36° C. |
| Amount of charge: | 3.5 F |
| Current strength; | 5 A |
| Conversion: | 95% |
| Yields of the target products: | |
| 2-phenyl-2,2-dimethoxyethanol: | 7% |
| 2-phenyl-2,2-dimethoxyacetaldehyde: | 25% |
| 2-phenylglyoxal dimethyl acetal: phenylglyoxylic acid methyl orthoester and methyl | 3% |
| 2-phenyl-2,2-dimethoxy acetate: | 1% |
| Total: | 36% |

COMPARATIVE EXAMPLE 3

| | |
|---|---|
| Batch: | 450 g of octanal<br>90 g of potassium iodide<br>2460 g of methanol |
| Cathode: | graphite |
| Anode: | graphite |
| Duration: | 3.76 h |
| Temperature: | 55–58° C. |
| Amount of charge: | 2 F |
| Current strength: | 5 A |
| Conversion: | >99% |
| Yield: | 30% |

COMPARATIVE EXAMPLE 4

| | |
|---|---|
| Batch: | 450 g of octanal<br>90 g of potassium iodide<br>2460 g of methanol |
| Cathode: | graphite |
| Anode: | graphite |
| Duration: | 3.76 h |
| Temperature: | 26–28° C. |
| Amount of charge: | 2 F |
| Current strength: | 5 A |
| Conversion: | >99% |
| Yield: | 40% |

COMPARATIVE EXAMPLE 5

| | |
|---|---|
| Batch: | 450 g of methylglyoxal dimethyl acetal<br>45 g of potassium iodide<br>2505 g of methanol |

-continued

| | |
|---|---|
| Cathode: | graphite |
| Anode: | graphite |
| Duration: | 5 h |
| Temperature: | 30° C. |
| Current strength: | 5 A |
| Conversion: | >99% |
| Selectivity: | 24.6% |
| Yield: | 24.6% 2,2,3,3-tetramethoxypropanol |

We claim:

1. A process for the preparation of a compound of the general formula I by subjecting a compound of general formula V to an electrochemical reaction in an electrolysis liquid with an alcohol of the general formula II in the presence of an auxiliary electrolyte and catalytic amounts of at least one metal salt (S) derived from a metal from sub-groups (groups) Ib (11), IIb (12), VIb (6), or VIIIb (8, 9, 10) of the periodic chart or from lead, tin or rhenium, wherein the compound of general formula I is:

I

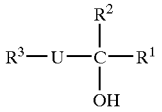

where $R^1$, $R^2$, $R^3$ are each independently hydrogen, $C_1$- to $C_{20}$-alkyl, $C_2$- to $C_{20}$-alkenyl, $C_2$- to $C_{20}$-alkynyl, $C_3$- to $C_{12}$-cycloalkyl, $C_4$- to $C_{20}$-cycloalkyl-alkyl, $C_1$- to $C_{20}$-hydroxyalkyl, or aryl or $C_7$- to $C_{20}$-arylalkyl which is unsubstituted or substituted by $C_1$- to $C_8$-alkyl, $C_1$- to $C_8$-alkoxy, halogen, $C_1$- to $C_4$-haloalkyl, $C_1$- to $C_4$-haloalkoxy, phenyl, phenoxy, halophenyl, halophenoxy, carboxyl, $C_2$- to $C_8$-alkoxycarbonyl or cyano, or $R^1$ and $R^2$ together are a $C_2$- to $C_9$-alkandiyl unit which is unsubstituted, monosubstituted or disubstituted by $C_1$- to $C_8$-alkyl, $C_1$- to $C_8$-alkoxy and/or halogen and in which one or two methyl groups is optionally replaced by a (CH═CH) unit and $R^3$ is an acetylated carbonyl group in which the alkoxy group is derived from an alcohol of the general formula II:

$$R^4—OH \qquad \text{II}$$

where $R^4$ is $C_1$- to $C_6$-alkyl, and

U is an acetylated carbonyl group in which the alkoxy group is derived from an alcohol of the general formula II; and wherein the compound of general formula V is:

V

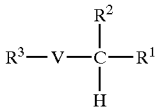

wherein:

V is a carbonyl group, or an acetylated carbonyl group having $C_1$- to $C_6$-alkoxy, $R^1$, $R^2$ and $R^3$ are each independently hydrogen, $C_1$- to $C_{20}$-alkyl, $C_2$- to $C_{20}$-alkenyl, $C_2$- to $C_{20}$-alkynyl, $C_3$- to $C_{12}$-cycloalkyl, $C_4$- to $C_{20}$-cycloalkyl-alkyl, $C_1$- to $C_{20}$-hydroxyalkyl, or aryl or $C_7$- to $C_{20}$-arylalkyl which is unsubstituted or substituted by $C_1$- to $C_8$-alkyl, $C_1$- to $C_8$-alkoxy, halogen, $C_1$- to $C_4$-haloalkyl, $C_1$- to $C_4$-haloalkoxy, phenyl, phenoxy, halophenyl, halophenoxy, carboxyl, $C_2$- to $C_8$-alkoxycarbonyl or cyano, or $R^1$ and $R^2$ together are a $C_2$- to $C_9$-alkandiyl unit which is unsubstituted, monosubstituted or disubstituted by $C_1$- to $C_8$-alkyl, $C_1$- to $C_8$-alkoxy and/or halogen and in which one or two methyl groups is optionally replaced by a (CH═CH) unit and $R^3$ is an acetalated carbonyl group having $C_1$- to $C_6$-alkoxy.

2. The process of claim 1 for the preparation of a compound of the general formula Ia:

Ia

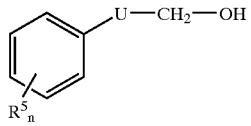

where U is as defined under the formula I,

I

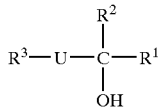

n is 0, 1, 2 or 3, and $R^5$ is $C_1$- to $C_8$-alkyl, $C_1$- to $C_8$-alkoxy, halogen, $C_1$- to $C_4$-haloalkyl, $C_1$- to $C_4$-haloalkoxy, phenyl, phenoxy, halophenyl, halophenoxy, carboxyl, $C_2$- to $C_8$-alkoxycarbonyl or cyano.

3. The process of claim 2, where the compound of the general formula Ia is 2-phenyl-2,2-dimethoxyethanol.

4. The process of claim 1, where the compound of the general formula I is a compound of the general formula:

$$H_{2m+1}C_m—CHOH—CH(OR^4)_2$$

where m is a number from 1 to 10, and $R^4$ is as defined under the formula II, and the compound of the general formula V is a compound of the general formula:

$$H_{2m+1}C_m—CH_2—CHO$$

5. The process of claim 1, where the compound of the formula I is 2,2,3,3-tetramethoxypropanol, and the compound of the general formula V employed is methylglyoxal dimethyl acetal.

6. The process of claim 1, where the anions of the metal salt (S) is derived from a mineral acid.

7. The process of claim 1, where the anions of the metal salt (S) is phosphate, sulfate, nitrate, perchlorate or halide.

8. The process of claim 1, where the cations of the metal salt (S) is iron, nickel, platinum, palladium, cobalt, zinc, silver or copper.

9. The process of claim 1, where the electrolysis liquid contains from 1 to 1,000 ppm by weight of the metal ions of the metal salt (S), based on the total amount of electrolysis liquid.

10. The process of claim 1, wherein the auxiliary electrolyte is a halogen-containing auxiliary electrolyte.

11. The process of claim 1, where the electrolysis liquid consists essentially of:

a compound of the general formula V, an alcohol of the general formula II, a halogen-containing auxiliary electrolyte, a catalytic amount of the metal salt (S), optionally the desired products of the general formulae I, optionally other by-products of electrolysis which are derived from the compounds of the general formulae I and V, and optionally, other conventional co-solvents.

12. The process of claim 1, wherein the proportion of the compound of general formula V is from 1 to 70% by weight, the proportion of the alcohol of the general formula II is from 14.9 to 94.9% by weight, the proportion of said auxiliary electrolyte is from 0.1 to 5% by weight, the proportion of any co-solvents present is from 0 to 70% by weight based on the electrolysis liquid and the proportion of product(s) of the general formulae I and V and of other by-products of electrolysis from the abovementioned compound(s) is from 1 to 70% by weight.

13. The process of claim 1, wherein the electrochemical reaction is carried out in an undivided electrolysis cell.

14. The process of claim 1, where the anodes employed are made of noble metals, noble-metal oxides, graphite or carbon materials, and the cathodes employed are made of iron, steel, nickel, zinc, noble metals, graphite or carbon materials.

15. A process for preparing a compound of general formula III comprising:

subjecting a compound of general formula Va to an electrochemical reaction in an electrolysis liquid with an alcohol of the general formula II in the presence of an auxiliary electrolyte and a catalytic amount of a metal salt (S) derived from a metal from sub-groups (groups) Ib (11), IIb (12), VIb (6), or VIIb (8, 9, 10) of the periodic chart or from lead, tin or rhenium;

wherein the alcohol of general formula II is:

$R^4$—OH, wherein $R^4$ is $C_{1-6}$ alkyl, wherein the compound of general formula III is:

$$R^3—V—W—R^1 \qquad \text{III}$$

wherein $R^1$ is hydrogen, and $R^3$ is exclusively aryl which is unsubstituted, or substituted by $C_1$- to $C_8$-alkyl, $C_1$- to $C_8$-alkoxy, halogen, $C_1$- to $C_4$-haloalkyl, $C_1$- to $C_4$-haloalkoxy, phenyl, phenoxy, halophenyl, halophenoxy, carboxyl, $C_2$- to $C_8$-alkoxycarbonyl or cyano; and V and W are independently a carbonyl group, or an acetalated carbonyl group having $C_1$- to $C_6$-alkoxy, with the proviso that one of the groups V and W is a carbonyl group and the other is an acetalated carbonyl group; and wherein the compound of general formula Va is:

Va

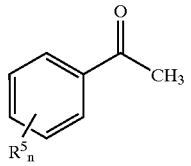

wherein:

$R^5$ is $C_1$- to $C_8$-alkyl, $C_1$- to $C_8$-alkoxy, halogen, $C_1$- to $C_4$-haloalkyl, $C_1$- to $C_4$-haloalkoxy, phenyl, phenoxy, halophenyl, halophenoxy, carboxyl, $C_2$- to $C_8$-alkoxycarbonyl or cyano, and n is, 1, 2 or 3.

16. The process of claim 15, wherein a compound of general formula IIIa:

IIIa

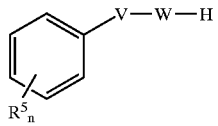

is prepared wherein n, V, W and $R^5$ are defined under formulae Va and III.

17. The process of claim 16, where the compound of general formula IIIa is 2-phenyl-2,2-dimethoxyacetaldehyde or 2-phenylglyoxal dimethyl acetal.

18. The process of claim 15, where the anions of the metal salt (S) is derived from a mineral acid.

19. The process of claim 15, where the anions of the metal salt (S) is phosphate, sulfate, nitrate, perchlorate or halide.

20. The process of claim 15, where the cations of the metal salt (S) is iron, nickel, platinum, palladium, cobalt, zinc, silver or copper.

21. The process of claim 15, where the electrolysis liquid contains from 1 to 1,000 ppm by weight of the metal ions of the metal salt (S), based on the total amount of electrolysis liquid.

22. The process of claim 15, wherein the auxiliary electrolyte is a halogen-containing auxiliary electrolyte.

23. The process of claim 15, where the electrolysis liquid consists essentially of:

a compound of general formula Va, an alcohol of general formula II, a halogen-containing the auxiliary electrolyte, a catalytic amount of the metal salt (S), optionally the compound of general formula III, optionally other by-products of electrolysis which are derived from the compounds of general formulae III and Va, and optionally, other conventional co-solvents.

24. The process of claim 15, wherein proportion of the compound of general formula Va is from 1 to 70% by weight, the proportion of the alcohol of general formula II is from 14.9 to 94.9% by weight, the proportion of said auxiliary electrolyte is from 0.1 to 5% by weight, the proportion of any co-solvents present is from 0 to 70% by weight based on the electrolysis liquid and the proportion of the product(s) of general formulae III and Va and of other by-products of electrolysis from the above mentioned compound(s) is from 1 to 70% by weight.

25. The process of claim 15, wherein the electrochemical reaction is carried out in an undivided electrolysis cell.

26. The process of claim 15, where the anodes employed are made of noble metals, noble-metal oxides, graphite or carbon materials, and the cathodes employed are made of iron, steel, nickel, zinc, noble metals, graphite or carbon materials.

27. A process for preparing a compound of general formula IV comprising:

subjecting a compound of general formula Vb to an electrochemical reaction in an electrolysis liquid with an alcohol of general formula II in the presence of an auxiliary electrolyte and a catalytic amount of at least one metal salt (S) derived from a metal from subgroups (groups) Ib (11), IIb (12), VIb (6), or VIIIb (8, 9, 10) of the periodic chart or from lead, tin or rhenium;

wherein the alcohol of general formula II is:

$R^4$—OH, wherein $R^4$ is $C_{1-6}$ alkyl, wherein the compound of general formula IV is:

$$R^3—V—W—O—R^4 \qquad \text{IV}$$

wherein:

$R^3$ is exclusively aryl which is unsubstituted, or substituted by $C_1$- to $C_8$-alkyl, $C_1$- to $C_8$-alkoxy, halogen, $C_1$- to $C_4$-haloalkyl, $C_1$- to $C_4$-haloalkoxy, phenyl, phenoxy, halophenyl, halophenoxy, carboxyl, $C_2$- to $C_8$-alkoxycarbonyl or cyano;

$R^4$ is $C_1$- to $C_6$-alkyl; and

V and W are independently a carbonyl group, or an acetalated carbonyl group having $C_1$- to $C_6$-alkoxy, with the proviso that one of the groups V and W is a carbonyl group and the other is an acetalated carbonyl group;

wherein the compound of general formula Vb is:

$$H_{2m+1}C_m—CH_2—CHO \qquad \text{Vb}$$

wherein m is 1, 2, 3, 4, 5, 6, 7, 8, 9 or 10.

28. The process of claim 27, where the anions of the metal salt (S) is derived from a mineral acid.

29. The process of claim 27, where the anions of the metal salt (S) is phosphate, sulfate, nitrate, perchlorate or halide.

30. The process of claim 27, where the cations of the metal salt (S) is iron, nickel, platinum, palladium, cobalt, zinc, silver or copper.

31. The process of claim 27, where the electrolysis liquid contains from 1 to 1,000 ppm by weight of the metal ions of the metal salt (S), based on the total amount of electrolysis liquid.

32. The process of claim 27, wherein the auxiliary electrolyte is a halogen-containing auxiliary electrolyte.

33. The process of claim 27, where the electrolysis liquid consists essentially of:

a compound of general formula Vb, an alcohol of general formula II, a halogen-containing auxiliary electrolyte, a catalytic amount of the metal salt (S), optionally the compound of general formula IV, optionally other by-products of electrolysis which are derived from the compounds of the general formulae IV and Vb, and optionally, other conventional co-solvents.

34. The process of claim 27, wherein proportion of the compound of the general formula Vb is from 1 to 70% by weight, the proportion of the alcohol of general formula II is from 14.9 to 94.9% by weight, the proportion of the auxiliary electrolyte is from 0.1 to 5% by weight, the proportion of any co-solvents present is from 0 to 70% by weight based on the electrolysis liquid and the proportion of the product(s) of the general formulae IV and Vb and of other by-products of electrolysis from the above mentioned compound(s) is from 1 to 70% by weight.

35. The process of claim 27, wherein the electrochemical reaction is carried out in an undivided electrolysis cell.

36. The process of claim 27, where the anodes employed are made of noble metals, noble-metal oxides, graphite or carbon materials, and the cathodes employed are made of iron, steel, nickel, zinc, noble metals, graphite or carbon materials.

37. A process for the preparation of a compound of general formula IVa:

IVa

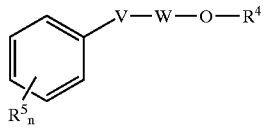

comprising:

subjecting a compound of general formula Va to an electrochemical reaction in an electrolysis liquid with an alcohol of general formula II in the presence of an auxiliary electrolyte and a catalytic amount of at least one metal salt (S) derived from a metal from subgroups (groups) Ib (11), IIb (12), VIb (6), or VIIIb (8, 9, 10) of the periodic chart or from lead, tin or rhenium;

wherein formula Va is:

Va

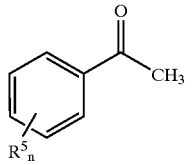

where in formulae IVa and Va, n is 0, 1, 2 or 3 and $R^5$ is $C_1$- to $C_8$-alkyl, $C_1$- to $C_8$-alkoxy, halogen, $C_1$- to $C_4$-haloalkyl, $C_1$- to $C_4$-haloalkoxy, phenyl, phenoxy, halophenyl, halophenoxy, carboxyl, $C_2$- to $C_8$-alkoxycarbonyl or cyano; and in formula IVa:

V and W are independently a carbonyl group, or an acetalated carbonyl group having $C_1$- to $C_6$-alkoxy, with the proviso that one of the groups V and W is a carbonyl group and the other is an acetalated carbonyl group; and $R^4$ is $C_{1-6}$ alkyl, wherein formula II is:

$$R^4—OH \qquad \text{II.}$$

38. The process of claim 37, where the compound of the general formula IVa is phenylglyoxylic acid methyl orthoester, and the compound of the general formula Va is acetophenone.

* * * * *